United States Patent [19]

Berke

[11] Patent Number: 4,913,390

[45] Date of Patent: Apr. 3, 1990

[54] PORTABLE ADJUSTABLE COMPUTER KEYBOARD SUPPORT AND HAND REST

[76] Inventor: Joseph J. Berke, 2063 Long Lake Shore Dr., West Bloomfield, Mich. 48033

[21] Appl. No.: 247,417

[22] Filed: Sep. 21, 1988

[51] Int. Cl.[4] ..... H05F 3/00

[52] U.S. Cl. ..... 248/176; 248/118.3; 248/918; 248/205.5

[58] Field of Search ..... 248/176, 118, 118.1, 248/118.3, 205.5, 205.3, 1 B, 678; 400/715, 718, 717

[56] References Cited

U.S. PATENT DOCUMENTS

| | | | |
|---|---|---|---|
| D. 160,224 | 9/1950 | Smyth . | |
| 393,496 | 11/1888 | Ashby . | |
| 1,277,169 | 8/1918 | Anderson | 400/175 X |
| 1,289,861 | 12/1918 | Mills . | |
| 1,632,537 | 6/1927 | Brigel . | |
| 1,801,669 | 4/1931 | Hintz et al. | 400/715 |
| 1,920,889 | 8/1933 | Pullen . | |
| 1,979,773 | 11/1934 | Ritch . | |
| 2,193,414 | 3/1940 | Berkman . | |
| 2,325,414 | 7/1943 | McChesney . | |
| 2,614,155 | 10/1952 | Lippy . | |
| 2,950,890 | 8/1960 | Hough, Jr. | 248/118 |
| 3,099,774 | 7/1963 | Crane . | |
| 3,268,766 | 8/1966 | Amos . | |
| 3,300,173 | 1/1967 | Kennedy, Jr. | 248/205.3 X |
| 3,300,250 | 1/1967 | Dollgener et al. . | |
| 3,711,742 | 1/1973 | Pinkham . | |
| 4,066,171 | 1/1978 | Fowlie . | |
| 4,303,960 | 12/1981 | Sherwood et al. . | |
| 4,313,112 | 1/1982 | Foster . | |
| 4,481,556 | 11/1984 | Berke et al. | 248/118 X |
| 4,482,063 | 11/1984 | Berke et al. . | |
| 4,482,064 | 11/1984 | Berke et al. . | |
| 4,621,781 | 11/1986 | Springer | 400/715 X |
| 4,688,862 | 8/1987 | Fowler et al. | 248/118.3 X |
| 4,709,972 | 12/1987 | LaBudde et al. | 400/715 X |

FOREIGN PATENT DOCUMENTS

| | | | |
|---|---|---|---|
| 310997 | 5/1931 | Canada . | |
| 751828 | 1/1967 | Canada . | |
| 1010487 | 5/1977 | Canada . | |
| 1913287 | 9/1970 | Fed. Rep. of Germany . | |
| 2203265 | 8/1973 | Fed. Rep. of Germany . | |
| 2836655 | 10/1979 | Fed. Rep. of Germany . | |
| 2910855 | 10/1980 | Fed. Rep. of Germany | 400/715 |
| 2074948 | 11/1981 | United Kingdom | 400/715 |

OTHER PUBLICATIONS

The Writing Machine, Michael H. Adler, George Allen & Unwin Ltd., London, pp. 176 and 254.

"Static Electricity Discharged from Quick Access Panels", Electronic Design, Jan. 4, 1975, p. 128.

IBM Technical Disclosure Bulletin, vol. 15, No. 7, Dec. 1972.

*Primary Examiner*—Ramon S. Britts
*Assistant Examiner*—Karen J. Chotkowski
*Attorney, Agent, or Firm*—Dykema Gossett

[57] ABSTRACT

A computer keyboard support assembly is disclosed that consists of a wrist support that can be adjusted to be tailored to an individual operator, keyboard or the like. In addition, an attachment assembly is disclosed so that the computer keyboard support assembly will be attached to the computer keyboard and will be moved therewith. This assembly provides a vertically and horizontally adjustable wrist support for the computer operator that will be moved with the computer keyboard as the computer operator moves the keyboard about his or her work station. The support may be adapted for use with rectangular or curved computer keyboards.

13 Claims, 1 Drawing Sheet

PORTABLE ADJUSTABLE COMPUTER KEYBOARD SUPPORT AND HAND REST

BACKGROUND OF THE INVENTION

The present invention relates to an improvement in computer keyboard supports that provides adequate wrist support for the user of a computer keyboard. Although the invention is primarily disclosed as being a computer keyboard support, it will also find use with any type keyboard.

The prior art computer keyboard support can be seen in U.S. Pat. No. 4,481,556 issued to Berke et al. and comprises a support assembly that was attached to a table or other piece of furniture. The support assembly comprised a wrist support member and a body support member that supported the computer keyboard. The keyboard would sit on the body member in such a way that the operator's wrist could rest on the wrist support while typing on the keyboard.

The main feature of the prior art computer keyboard support assembly was the wrist support that attempted to solve carpal tunnel syndrome and physical disabilities secondary to lack of manual ergonometric considerations. Carpal tunnel syndrome is a major problem faced in the modern-day office and is widely described in the medical literature. This is a problem faced by operators of any keyboard-type mechanism and consists of pain within the wrist due to the unnatural positions that the wrist must be held in in order to type for a period of time due to repeated flexion and extension movements of an unsupported wrists, leading to entrapment of a swollen median nerve between the distal heads of the radius, ulna and carpal bones posteriorly and the transverse volar carpal ligament anteriorly. By providing the wrist support, the operator can rest his or her wrists upon the wrist support and avoid the carpal tunnel syndrome, as well as arm, neck and shoulder symptoms resulting in loss of work and temporary or permanent disability.

The prior art computer support assembly was not entirely successful in eliminating carpal tunnel syndrome. Two problems have been identified in the prior art computer keyboard support assembly. First is the fact that some prior art computer keyboard supports were attached to the furniture. That is, the support assembly was bolted or somehow attached to the operator's table or desk. This proved impractical in the modern office environment. In the modern office environment, a worker often is seated in a work station that surrounds him. His phone may be on a desk to his left, while his computer keyboard and computer terminal is directly in front of his seat. Also, there may be records or other papers on a desk to the right. In such an environment, a worker must swivel around and work in many positions or on all three desks. As a result, the worker would frequently move the computer keyboard around with him as he swiveled in his work station. Due to this fact, the computer keyboard was often found separated from the computer keyboard support assembly mount or askew from a support fixed to the furniture. Therefore, the operator was not gaining the benefit of the wrist support. Since these workers were not using the wrist support, they still experienced the carpal tunnel syndrome and other potentially avoidable physical disabilities or complaints, such as arm, neck or shoulder symptoms.

Another problem of the prior art computer keyboard support assembly was that the wrist support was at a fixed height and distance from the operator edge of the keyboard. In reality, computer terminal operators are of course of a variety of body sizes, torso heights and have various size hands. In addition, many of them may have long fingernails. Due to these variables, as well as the possibility that different operators may successively use the same computer keyboard, the computer keyboard wrist support would often be at an improper height and thus of limited use to the operator. In a situation such as this, the operator would not fully benefit from the beneficial effects of the wrist support and would still experience carpal tunnel syndrome and upper extremity afflictions.

The present invention seeks to solve these problems in the prior art by providing a computer keyboard support assembly that will be mounted upon the computer keyboard and thus be moved with it by the operator. In addition, the present invention discloses an adjustable wrist support that can be adjusted by the operator to suit his or her individual needs.

SUMMARY OF THE INVENTION

This invention relates to an improved computer keyboard support which is applied to, and remains with, the keyboard when the keyboard is moved about, and which can be adjusted to give good support for the user's wrist notwithstanding different size users.

The present invention has a base member with an upstanding wrist support section, in which the base member has an adjustable securing mechanism for locking the computer keyboard support assembly to the computer keyboard. In addition, the present invention provides adjustment means, as for example, slots and wing nuts that allow the wrist support member's vertical height and horizontal distance to be adjusted so as to conform to the individual characteristics of the particular operator.

It is an object of the present invention to provide a computer keyboard support assembly that will move with the computer keyboard and not be a part of the furniture.

It is further an object of the present invention to provide a computer keyboard support assembly that can be easily adjusted so as to be conformed to the individual operator's needs.

It is further an object of the present invention to make such a computer keyboard support assembly that will be applicable to a wide variety of shapes of computer keyboards, including curved keyboards.

It is an additional object of the present invention to achieve these various goals with a computer keyboard support assembly that is light, attractive, formed of a minimum number of parts and is cheaply assembled.

These and other features and objectives of the present invention can be best understood when considered in combination with the following specification and drawings.

DETAILED DESCRIPTION OF THE PREFERRED EMBODIMENTS

A computer keyboard support apparatus consists of computer keyboard 18 and computer keyboard support assembly 15.

Figure 1:
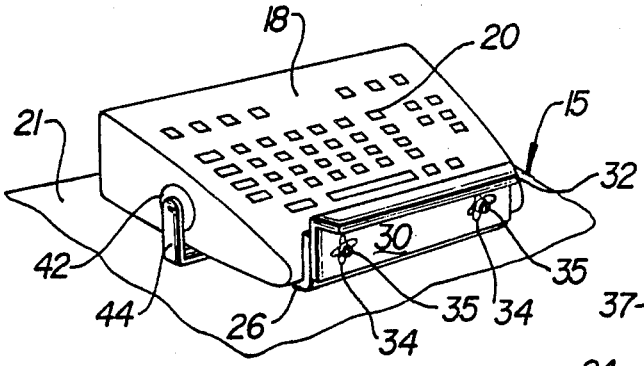
FIG. 1 is a perspective view of a first embodiment of the present invention showing the computer keyboard mounted within the computer keyboard support assembly.
Figure 2:
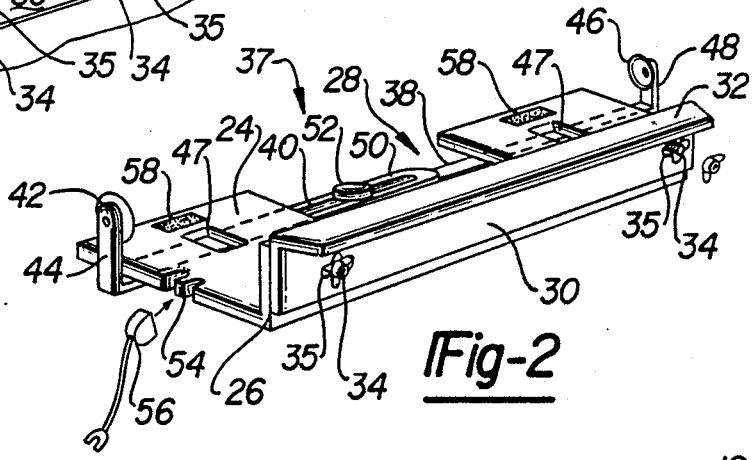
FIG. 2 is a perspective view of the computer keyboard support assembly of the present invention showing its various components.

With reference to FIG. 1, a first embodiment 15 of the computer keyboard support assembly of the present invention is shown attached to a computer keyboard 18. The computer keyboard 18 and the associated support assembly 15 are shown resting on a desk 21. It is to be understood that the computer keyboard and the support assembly are not attached to the desk and can move with respect to the desk. The computer keyboard includes keys 20 upon which the operator will key in instructions to the computer.

The computer keyboard support assembly 15 is comprised of a first flat portion 24 having an upwardly turned edge portion 26. An adjustable wrist support plate 30 is secured to the upwardly turned edge portion 26 by wing nuts 35. The vertical height of the wrist support plate 30 can be adjusted by loosening the wing nuts 35 and moving them within slots 34 formed in the wrist support plate 30. When the proper vertical height has been selected, the wing nuts 35 are then retightened, and the adjustable wrist support plate 30 is again secured to the upwardly turned edge portion 26. This assembly allows the adjustment of the wrist support plate 30 with respect to the computer keyboard 18 so as to allow the wrist support plate to be easily tailored to a particular keyboard or an individual operator's personal characteristics. The wrist support plate 30 includes an outwardly extending wrist support 32 that actually supports the wrist while the operator is typing on the keyboard.

Figure 3:
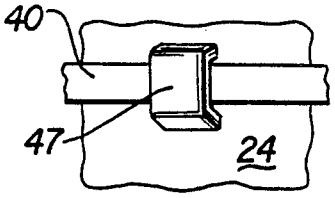
FIG. 3 is a partial view showing the bottom of the computer keyboard support assembly of the present invention.

In order to assure that the wrist support plate will move with the computer terminal, and in order to allow the wrist support plate to be utilized on existing computer terminals, an adjustable, lateral keyboard mount 37 is disposed upon the flat plate 24. The adjustable lateral keyboard mount 37 consists of a right sliding member 38 and a left sliding member 40. The right sliding member 38 has a right abutment panel 48 formed extending upwardly therefrom and a right suction member 46 mounted to the right abutment panel 48. The left sliding member 40 has a similar left abutment panel 44 extending upwardly therefrom and a left suction member 42 mounted to the left abutment panel. As shown in FIG. 1, the suction members 42, 46 are the members that actually attaches the keyboard support assembly to the computer keyboard. The left sliding member 40 includes a slot 50 with a nut 52 sliding therein. The nut 52 is attached to the right sliding member 38, and the two sliding members 38, 40 are slid with respect to each other until the suction members 42, 46 engage the two lateral sides of a particular computer keyboard 18. At that point, the nut 52 is tightened to secure the computer keyboard support 15 to the computer keyboard 18. The suction members 42, 46 are also mounted on bolts within the abutment members 44, 48. This allows fine tightening of the suction members 42, 46 so as to provide a very secure engagement with the computer keyboard 18. Sticky pads 58 are also disposed on the flat portion 24 so as to better secure the computer keyboard to the computer keyboard support assembly 15. The sliding members 38, 40 are both guided in yokes 47 formed in the flat portion 24. As can be seen in FIG. 3, the yoke portion 47 underlies the sliding members 38, 40 and provides a guide for it. By securing the suction members 42, 44 to various positions on the sides of the keyboard, the operator can adjust the horizontal position of the keyboard and the distance between the keyboard and the wrist support.

Figure 4:
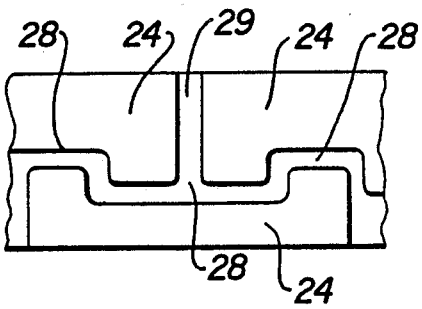
FIG. 4 is a partial view showing a piece of metal stock from which the keyboard terminal assembly base members are formed.

As can be seen, the flat portion 24 has a cut-out portion 28 extending inwardly from a rear wall thereof. The cut-out portion 28 extends for about half the length of the flat portion 24 along the rear wall. The U-shaped cut-out portion not only reduces the overall weight of the computer keyboard support assembly but also allows cheaper manufacture thereof. As can be seen in FIG. 4, a series of base plate 24 are stamped out of a metal sheet 29. By interfitting the cut-out and non-cut-out portions of the base plates 24, a significant reduction in the amount of material needed to manufacture the base plates is achieved.

The computer keyboard support assembly 15 includes a static electricity grounding mechanism that is formed by an attachment flange 54 and a ground wire 56 mounted thereon. The grounding assembly serves to ground out static electricity between the operator and the keyboard 20.

Figure 5:
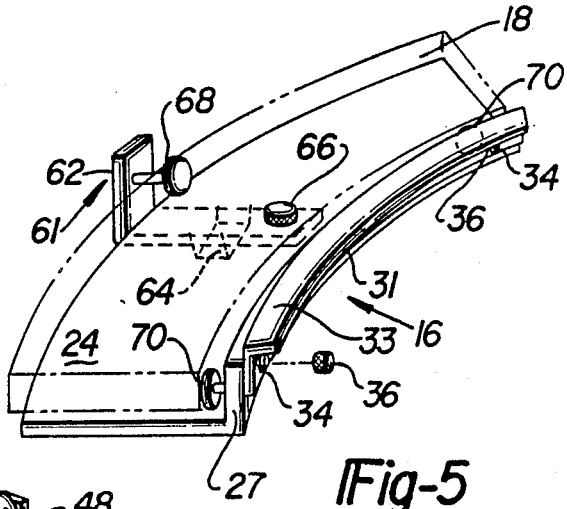
FIG. 5 is a perspective view showing a second embodiment of the computer keyboard support assembly that is mounting a curved keyboard.

FIG. 5 shows a second embodiment 16 of the computer keyboard support assembly of the present invention that is adapted to mount a curved keyboard 18. As can be seen from FIG. 4, the second embodiment 16 comprises a curved, adjustable wrist support plate 31 with a curved wrist support 33 mounted thereon. The flat base portion 24 includes an upwardly extending curved edge portion 27 upon which the curved wrist support 31 is adjustably mounted. Slots 34 are formed in the curved plate 31 and a thumb bolt 36 is illustrated as the securing member in this second embodiment; however, a wing nut or any other securing member could be used. A cut-out, similar to cut-out 28, could be formed in this embodiment.

The second embodiment uses a radial mount since many keyboards are flimsy at their lateral ends. The adjustable radial keyboard mount 61 consists of a sliding rear wall abutment 62 with a rear abutment pad 68 mounted thereto. The sliding rear wall abutment 62 slides in a yoke 64 formed on the bottom of the base plate 24 and has a thumb nut 66 that secures the sliding abutment member 62 at a particular spot with respect to the base plate 24. Front abutment pads 70 are also disposed in the front of the computer keyboard support assembly 16 on the upwardly extending curved edge 27. The curved computer keyboard 18 is thus captured between the rear abutment pad 68 and the two front abutment pads 70. It is to be understood that the abutments 68, 70 are mounted on bolts within the members 62, 27 and thus can be tightened by merely turning the bolts with respect to the members 62, 27. By adjusting the relative extents of members 70 and 68, the horizontal position of the keyboard 18 may be adjusted with respect to the wrist support 31.

Figure 6:
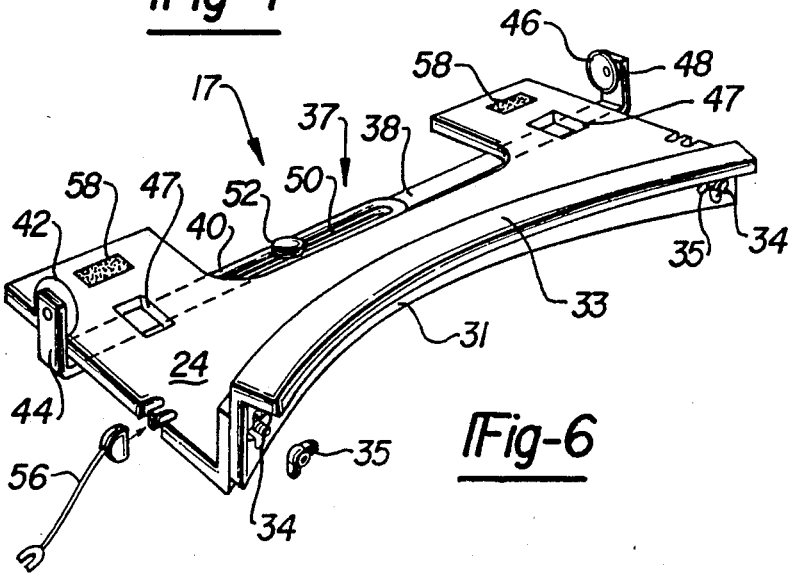
FIG. 6 is a perspective view of a third embodiment of the computer keyboard support assembly that also mounts a curved keyboard.

FIG. 6 discloses a third embodiment of the computer keyboard support assembly of the present invention. The third embodiment consists of an adjustable lateral keyboard mount 37 identical to that disclosed in the first embodiment and an adjustable curved wrist support plate 31 identical to that disclosed in the second embodiment. The third embodiment acts to secure the lateral ends of a curved keyboard 18 and thus secure the computer keyboard support 17 with respect thereto.

Figure 7:
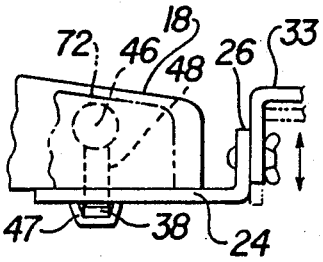
FIG. 7 is a fragmentary, schematic view showing horizontal and vertical adjustments of the wrist support.

FIG. 7 illustrates features of the first and third embodiments, namely, the wrist support 39 may be vertically adjusted to anyone of several positions as shown in phantom at 71. The distance between the keyboard and the wrist support 39 can thus be adjusted. Also, the keyboard 18 can be secured by the suction members 41, 46 at any one of several horizontal positions, as shown by phantom at 72, to adjust the distance between the keyboard and the wrist support.

The base plate member 24 and the adjustable wrist support members 30, 31 can be formed of plastic or any suitable metal. Also, Velcro or any suitable member could be mounted upon the wrist support 32, 33 in order to aid in dispersing static electricity from the operator's hand.

It should be appreciated that many changes may be made without departing from the spirit and scope of the present invention. The present invention, therefore, should be limited only by the following claims.

What is claimed is:

1. A computer keyboard support apparatus, comprising:

a computer keyboard;

a support assembly comprising, a base member with a flat portion supporting said computer keyboard on a support surface and a vertical portion;

said flat portion having front, back and two lateral side faces;

said vertical portion extending vertically upwardly from said front face of said flat portion;

an adjustable wrist support member adjustably mounted on said vertical portion and having means for vertically adjusting the vertical height of said wrist support with respect to said vertical portion to suit an individual computer operator, or type of keyboard; and said wrist support being generally parallel to and spaced from said computer keyboard by a first distance, a releasable attachment assembly releasably attaching said computer keyboard to said support assembly, allowing adjustment of said first distance.

2. A computer keyboard support apparatus as recited in claim 1, and further wherein said flat portion has a cut-out portion formed therein extending from said back face towards said front face and extending for about half the distance between said two side faces, said cut-out portion making the computer keyboard support substantially lighter and cheaper to manufacture.

3. A computer keyboard support apparatus as recited in claim 1, and wherein said attachment assembly comprises attachment members associated with each side face of said flat portion, each attachment member having a sliding portion and one of said attachment members being formed with a slot;

said attachment assembly futher including a lock member so that said attachment assembly allows said attachment members to be moved with respect to one another so as to adjust said attachment members into engagement with the computer keyboard at which time the lock members can be engaged so as to secure said attachment members at a particular position.

4. A computer keyboard support apparatus as recited in claim 3, and further wherein said vertical portion and said wrist support members are both curved outwardly away from the back face in a convex shape so as to accommodate a curved keyboard.

5. A computer keyboard support apparatus as recited in claim 1, and further wherein said attachment assembly comprises a member that is disposed behind said back face and is moved forwardly towards said back face to a correct securing position to secure said computer keyboard and further wherein a lock member can lock said member to said base member at the correct securing position.

6. A computer keyboard support apparatus as recited in claim 5, and further wherein said vertical portion and said wrist support member are both curved outwardly away from the back face in a convex shape, so as to accommodate a curved keyboard.

7. A computer keyboard support apparatus as recited in claim 1, and further wherein pads of a sticky material are secured to the upward face of said base member in order to provide additional attachment to said computer keyboard.

8. A computer keyboard support apparatus, comprising:

a computer keyboard;

a support assembly comprising, a base member with a flat portion, said flat portion supporting said computer keyboard on a support surface, and a vertical portion;

said vertical portion being generally parallel to said computer keyboard, extending vertically upwardly from said flat portion, and spaced horizontally from said computer keyboard by a first distance;

an adjustable wrist support member mounted on said vertical portion and having means for vertically adjusting the height of said wrist support and means for fixing said wrist support at preselected heights;

a releasable attachment assembly that attaches said support assembly to said computer keyboard so that said support assembly and said wrist support member will be portable with said computer keyboard, said releasable attachment assembly allowing adjustment of said first distance, said releasable attachment assembly securing said keyboard at a selected position with respect to said support assembly.

9. A computer keyboard support apparatus as recited in claim 8, and further wherein said attachment assembly can be adjusted so as to correspond to the shape of a particular computer keyboard, thus allowing a single attachment assembly to be used to mount a support assembly to a variety of different computer keyboards.

10. A computer keyboard support appartus, comprising:

a base member with a flat portion and a vertical portion;

said flat portion having front, back and two lateral side faces;

said vertical portion extending vertically upwardly from said front face of said flat portion;

an adjustable wrist support member having means for adjustably mounting said wrist support member on said vertical portion so that the vertical height of said wrist support member, with respect to said vertical portion, can be adjusted to suit an individual computer operator, or type of keyboard;

an attachment assembly comprising attachment members associated with each of said side faces of said flat portion, each of said attachment members having a sliding portion and one of said attachment members being formed with a slot;

said attachment assembly further including a lock member so that said attachment assembly allows said attachment members to be moved with respect to one another to adjust said attachment members into engagement with the computer keyboard at which time said lock member can be engaged so as to secure said attachment members at a particular position;

said vertical portion and said wrist support member both being curved outwardly away from the back face in a convex shape so as to accommodate a curved keyboard.

11. A computer keyboard support apparatus, comprising:

a base member with a flat portion and a vertical portion;

said flat portion having front, back and two lateral side faces;

said vertical portion extending vertically upwardly from the front face of said flat portion;

an adjustable wrist support member having means for adjustably mounting said wrist support member on said vertical portion so that the vertical height of said wrist support member, with respect to said vertical portion, can be adjusted to suit an individual computer operator, or type of keyboard;

means mounting said wrist support members for horizontal adjustment towards and away from the keyboard;

said computer keyboard support further comprises an attachment assembly that attaches the computer keyboard to the support assembly so that the support assembly can be moved with the computer keyboard;

said attachment assembly comprises a member that is disposed behind said back face that can be moved forwardly towards said back face to a correct securing position to secure the computer keyboard and further wherein a lock member can lock said member to said base member at the correct securing position.

12. A computer keyboard support apparatus, comprising:

a computer keyboard;

a support assembly comprising, a base member with a flat portion, said flat portion defines a means for supporting said computer keyboard on a support surface and a vertical portion;

said vertical portion being generally parallel to said computer keyboard, extending vertically upwardly from said flat portion, and spaced horizontally from said computer keyboard by a first distance;

a wrist support member mounted on said vertical portion;

a releasable attachment assembly that attaches said support assembly to said computer keyboard so that said support assembly and said wrist support member will be portable with said computer keyboard, said releasable attachment assembly allowing adjustment of said first distance, said releasable attachment assembly securing said computer keyboard at a selected position with respect to said support assembly.

13. A computer keyboard support apparatus, comprising:

a computer keyboard having a width;

a wrist support member being generally parallel to said computer keyboard width, said wrist support being of a width approximately equal to said computer keyboard width, extending generally vertically upwardly and spaced horizontally from said computer keyboard by a first distance;

a releasable attachment assembly means for attaching said wrist support member to said computer keyboard so that said wrist support member will be portable with said computer keyboard and for providing adjustment of said first distance, said releasable attachment assembly securing said computer keyboard at a selected position with respect to said wrist support member.

* * * * *